United States Patent [19]

Gass et al.

[11] 4,072,797

[45] Feb. 7, 1978

[54] DIFFUSION BARRIER AND SEPARATION SUBSTANCE FOR METAL PARTS ADJOINING EACH OTHER IN AN OXYGEN FREE ATMOSPHERE

[75] Inventors: Hans Gass, Neuchatel; Hans Erich Hintermann, Ins, both of Switzerland; Hartmut Griepentrog, Oberhausen, Germany

[73] Assignees: Laboratoire Suisse de Recherches Horlogeres, Switzerland; Gutehoffnungshutte Sterkrade Aktiengesellschaft, Germany

[21] Appl. No.: 601,538

[22] Filed: Aug. 4, 1975

[30] Foreign Application Priority Data

Aug. 28, 1974 Germany ..... 2441260

[51] Int. Cl.[2] ..... C01B 21/06; C01B 35/08; B32B 15/04

[52] U.S. Cl. ..... 428/409; 60/39.08; 60/200 A; 308/240; 308/241; 308/DIG. 9; 423/290; 428/472; 428/539

[58] Field of Search ..... 60/200 A, 39.08; 308/241, 240, DIG. 9; 428/911, 457, 469, 472, 409, 539; 423/284, 290

[56] References Cited

U.S. PATENT DOCUMENTS

| | | | |
|---|---|---|---|
| 2,901,380 | 8/1959 | Crump | 428/469 X |
| 3,084,064 | 4/1963 | Cowden et al. | 428/457 |
| 3,122,883 | 3/1964 | Terner | 60/200 A |
| 3,399,979 | 9/1968 | Hamling | 423/284 X |
| 3,423,279 | 1/1969 | Grover | 428/469 X |
| 3,473,894 | 10/1969 | Babl | 423/290 |
| 3,768,972 | 10/1973 | Taylor et al. | 423/284 X |
| 3,854,503 | 12/1974 | Nelson et al. | 60/39.65 |
| 3,868,234 | 2/1975 | Fontanella | 423/290 X |
| 3,880,574 | 4/1975 | Irwin | 60/39.65 X |
| 3,911,672 | 10/1975 | Irwin | 60/39.32 |
| 3,959,443 | 5/1976 | Kabayama | 423/290 |

*Primary Examiner*—Harold Ansher
*Attorney, Agent, or Firm*—McGlew and Tuttle

[57] ABSTRACT

A diffusion barrier and separation substance for metal parts which adjoin each other in an oxygen-free, inert and preferably a helium-containing atmosphere such as used in a closed-cycle high temperature reactor or gas turbine comprises first and second adjoining metal parts with a hexagonal boron nitride placed between said parts. The hexagonal boron nitride is applied to the boundary surface of the metal parts in an aqueous or organic suspension prepared as a pasty, putty-like or brushable liquid substance. The substance contains from 5 to 50% of boron nitride, from 0.5 to 30% of binders and from 2 to 6% of swelling agents and 50 to 90% liquid suspension medium. The suspension medium may advantageously contain an anti-corrosive agent and in addition the formed protective film is burned from 0.25 to 3 hours at a temperature of from 100° to 500° C.

4 Claims, 1 Drawing Figure

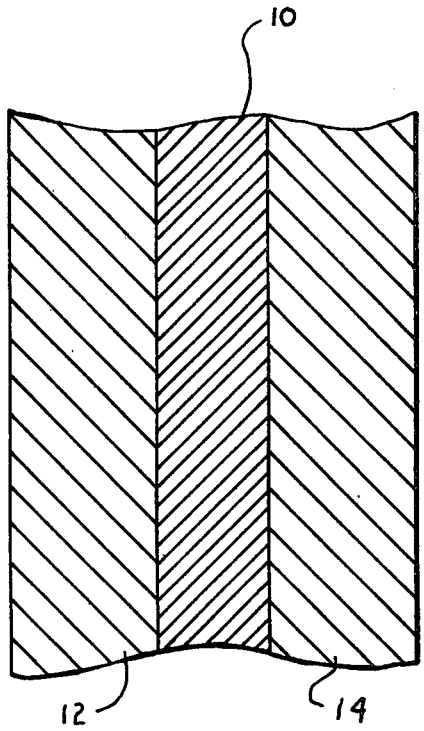
10
12
14

DIFFUSION BARRIER AND SEPARATION SUBSTANCE FOR METAL PARTS ADJOINING EACH OTHER IN AN OXYGEN FREE ATMOSPHERE

BACKGROUND OF THE INVENTION

1. Field of the Invention

This invention relates in general to a diffusion barrier and separation substance for metal parts which adjoin each other in an oxygen-free atmosphere and in particular to a new and useful diffusion barrier and to a method of forming the barrier.

2. Description of the Prior Art

The present invention deals particularly with a diffusion barrier and a separation substance for metal parts which adjoin each other in an oxygen-free, inert, preferably helium-containing atmosphere such as used in a closed cycle high temperature reactor or gas turbine. Adhesion, friction and wear of metals which contact each other statically or in a sliding or rolling motion usually increases with the increasing temperature. The difficulties resulting therefrom can be kept within acceptable limits as long as the ambient atmosphere contains oxygen or an oxygen along with a water vapor and the interengaged materials are made of high temperature alloys forming stable oxides. Such oxide films on surfaces prevent an intimate contact between the metals. It is true that in this case also even with small loads very high specific surface pressures are produced on the surface peaks contacting each other, so that the surface peaks are plastically deformed. This causes the protective oxide films to be interrupted and locally limited welded areas may be formed. However due to the sliding motion, such weld bridges are sheared off. The broken metal surface areas are chemically highly active and in a surrounding oxidizing atmosphere they tend to coat themselves immediately with a new protective oxide film.

Such a healing process cannot take place however with the mating surfaces located in a vacuum or in an inert atmosphere. Such conditions result in very high frictional coefficients, with values much higher than one, and in a rapid destruction of the mating surfaces and with an intense wear thereof. If the contacting bodies do not move for long periods of time, alloyed structures may form over large surface areas by local welding and the adhesion forces may grow to values reaching the strength of the material itself.

This problem is particularly important in connection with the development of helium gas turbines and helium cooled high temperature reactors and becomes manifest, for example, through a premature wear and failure of bearings and a deformation and rupture of parts especially of pipes which can no longer freely move in accordance with the temperature gradient and also in such applications as diffusion welding of screw connections, flanges, buckets, fastening elements, etc.

SUMMARY OF THE INVENTION

The present invention is an improvement over the prior art in respect to the provision of a diffusion barrier with a separation substance for the metal parts for use in an oxygen free, inert and preferably helium containing atmosphere. In accordance with the invention the diffusion barrier is formed by placing a boron nitride as a separation substance between the adjoining metal parts. The separation substance is prepared as a pasty, putty-like, or liquid composition which is preferably sprayable or brushed on as a suspension. The suspension comprises from 5 to 50% and preferably from 15 to 40% of a hexagonal boron nitride, from 0.5 to 30% of binders, from 2 to 6% of swelling agents and from 50 to 95% of a liquid forming a single or multi-component suspension medium which may contain anti-corrosive agents in addition. This separation substance is applied to the boundary surface whereby a protective film is formed which is burned in for 0.25 to 3 hours at a temperature of from 100° to 500° C.

Advantageously the suspension substance is applied to adjoining metal parts which are made of a nickel containing alloy and have smooth boundary surfaces and are connected to each other by fixing elements or mounted for sliding movement relative to each other for example in a thermoelastic suspension or in sheet packs.

Accordingly, it is an object of the invention to provide an improved diffusion barrier and separation substance for metal parts which adjoin each other in an oxygen free, inert preferably helium containing atmosphere such as used in a closed cycle high temperature reactor or gas turbine and which includes a hexagonal boron nitride between two adjoining metal parts.

A further object of the invention is to provide a substance forming a diffusion barrier which is inexpensive and of simple construction.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWING

The only FIGURE of the drawing is a sectional view showing the dispersion barrier including the two metal plates which are separated by a hexagonal boron nitride.

DESCRIPTION OF THE PREFERRED EMBODIMENT

Referring to the drawing in particular a suspension substance generally designated 10 is applied to adjoining metal parts 12 and 14 and forms a diffusion barrier with the parts. The metal parts 12 and 14 are advantageously a nickel containing alloy having a smooth boundary surface which are connected together by fixing elements or which are mounted for sliding movement relative to each other in a thermoelastic suspension or in sheet packs and which are arranged in an oxygen free, inert atmosphere which preferably contains helium.

The use of boron nitrides as a lubricant, as a thermal shield, and as a protection agent against the cohesion of glass beads is known. Preparations of boron nitride with binders are also known. In these cases however the problems mentioned are not encountered that is the formation of welded areas between adjoining metal parts and their prevention, and therefore they are not suggested for use as a dispersion barrier between metal plates. The effect of placing boron nitride as a diffusion barrier between the boundary surfaces of metal plates 12 and 14 is surprising.

It has been found that the strong adhesion welding can be prevented and the friction and wear can be effectively reduced if at least one of the two interacting solid bodies 12 and 14 is coated in the contact areas between them with a thin protective film 10 containing the hexagonal boron nitride.

The inventive protective layer meets the following important requirements:

It acts as a diffusion barrier and thus prevents the metallic contact of the adjoining bodies.

It does not diffuse into the carrier material and consequently cannot migrate not even over long periods of service time at high temperatures.

It has excellent sliding properties. .

It is chemically stable and therefore does not form any aggressive decomposition products.

It is effective over a very large temperature range.

It is stable also in an oxidizing atmosphere and at a temperature of up to 1400° C so that its protective effect is not affected by possible intense contamination of a helium atmosphere, for example by water vapor penetration.

It has a high thermal conductivity so that no heat transfer problems arise.

It is highly resistant to thermal shocks.

Examples of the invention are as follows:

Two flange couples made of a high temperature resistant iron-chromium-nickel material are examined for comparison. Flange couple No. 1 has not been treated. Flange couple No. 2 has a contact surface of one flange treated with an aqueous suspension comprising 30% by weight of hexagonal boron nitride, 4% by weight of sodium metaborate as an organic binder, and 3% by weight of a carboxylmethyl-cellulose in order to form a thin uniform protective film. The layer or film is burned in for half an hour in the air at 400° C.

Both flange couples are then screwed together with bolts having threads which have been previously coated with the protective film and they are tightened with an average contact pressure of 50 kg/cm$^2$. After a thermal treatment for 100 hours at 750° C in pure helium having a water vapor and an oxygen content respectively below 5 parts per million, the attempt is made to separate the flanges again with the following result:

All bolt connections can be unscrewed easily.

Flange couple No. 2 does not show any adhesion and can be separated without damage and without use of force.

Flange couple No. 1 is welded together so strongly that the flanges cannot be separated from each other by a tensile force of 200 kg/cm$^2$.

In another example, 10 casing bolt connections made of a high temperature resistant nickel-chromium-cobalt alloy have been treated with a paste comprising 25% by weight of hexagonal boron nitride and 10% by weight of an organic acryl base binder in an organic solvent. The thread bolts only were treated. Prior to the threading of the bolts, lacquer is burned in for two hours at 120° C. The bolts are tightened with a torque of 4 kgm. Further the same number of non-treated casing bolt connections of the same material are screwed together also with a torque of 4 kgm.

After a heat treatment of all the bolt connections for 100 hours at 750° C in pure helium, all of the bolts treated with the boron nitride containing paste can be unscrewed with a torque of from 1 to 3 kgm while the non-treated bolts were diffusion welded and could no longer be unscrewed or upon using a high torque are ripped off.

The invention is also applicable to piping applications for conducting hot gases for example helium. In this case in the sheet packs and metal mats forming the insulation relative movements occur due to temperature variations. As soon as a local diffusion welded area prevents free movement, deformations appear which can destroy the insulation or at least considerably reduce the insulation effect.

While applying the invention both the separating capability and the very satisfactory sliding properties of the hexagonal boron nitride become effective.

As to the application of the separation substances containing the hexagonal boron nitride, choice may be made between an aqueous and an organic suspension, with a preferable use of the aqueous suspension having a thixotropic property due to the presence of a suitable swelling agent, that is being relatively easily deformable but assuming a relatively high virtual viscosity immediately after the application which counteracts a too rapid spreading and dropping off before the drying. The organic suspension is usable in cases where the presence of a minimal binder is disturbing that is in cases where after a thermal treatment pure, non-bonded boron nitride has to be left as a residual dry lubricant.

In an aqueous boron nitride suspension it is advisable to choose a lower binding proportion such as from 0.5 to 2.5%. As a swelling agent it is advantageous to use the sodium salt of the carboxy methyl-cellulose in a quantity of from 2 to 6% and preferably 3%. Approximately 0.5% of sodium nitride may be added as a corrosion protector.

In an organic boron nitride suspension, in general the binder proportion will be higher, depending on the desired consistency, approximately 6 to 15% (for putty-like masses the upper values, even up to 30% should be used. The same substance (a polymeric compound) may be used in the suspension both as a binder and as a swelling agent (increase of the viscosity). The balance is a mixture of organic solvents.

As components of the separation substance, trisodium phosphate, sodium carbonate, sodium metasilicate and sodium metaborate may be used in an aqueous suspension as a binder. In view of the suspended boron nitride the sodium metaborate is particularly suitable.

As the swelling agent, the commercially available sodium salt of a carboxy methy cellulose is usable; however, other conventional swelling agents are equally suitable.

In organic suspensions, a particularly appropriate binder and swelling agent is a polymethyl methacrylate having the property of volatilizing at higher temperatures without residue or great decomposition. Other polymers, for example polystyrene, may also be used.

As suspended media, such ones are to be used which dissolve the polymeric binder and on the other hand permit a progressive drying. The following composition is advantageous for example:

40% of methylene chloride
30% of acetone
20% of methyl ethyl ketone
10% of toluene While a specific embodiment of the invention has been shown and described in detail to illustrate the application of the principles of the invention, it will be understood that the invention may be embodied otherwise without departing from such principles.

What is claimed is:

1. A diffusion barrier and separation substance for metal parts adjoining each other in an oxygen-free, inert, and preferably in a helium-containing atmosphere such as is used in a closed-cycle high-temperature reactor, comprising first and second metal parts with a hexagonally crystallized boron nitride forming a diffusion barrier and separation between said parts, wherein said hexagonally crystallized boron nitride is applied as a suspension to the adjoining metal parts, said metal parts being of a nickel-containing alloy and having smooth boundary surfaces therebetween, said parts being mounted for sliding relative movement in a thermoelastic suspension.

2. A diffusion barrier and separation substance for metal parts adjoining each other in an oxygen-free, inert, and preferably in a helium-containing atmosphere such as is used in a closed-cycle high-temperature reactor, comprising first and second metal parts with a hexagonally crystallized boron nitride forming a diffusion barrier and separation between said parts, said hexagonally crystallized boron nitride being applied to the boundary surface between the metal parts in an aqueous suspension prepared as a pasty liquid comprising from 5 to 50% of hexagonal boron nitride, 0.5 to 30% of binders, 2 to 6% of swelling agents, and 50 to 95% of a liquid suspending medium to form a protective film.

3. A diffusion barrier according to claim 2, wherein said protective film is burned in for 0.25 to 3 hours at a temperature of from 100° to 500° C.

4. A diffusion barrier according to claim 2, wherein said boron nitride is from 15 to 40% of the pasty liquid.

* * * * *